United States Patent [19]

Gurubatham et al.

[11] 4,418,868

[45] Dec. 6, 1983

[54] DISHWASHER UPPER SPRAY ARM

[75] Inventors: Vincent P. Gurubatham, St. Joseph; James G. Ruspino, St. Joseph Township, Berrien County, both of Mich.

[73] Assignee: Whirlpool Corporation, Benton Harbor, Mich.

[21] Appl. No.: 268,290

[22] Filed: May 29, 1981

[51] Int. Cl.[3] ..... B05B 3/00; B05B 3/02

[52] U.S. Cl. ..... 239/228; 239/246; 239/251; 239/553.5

[58] Field of Search ..... 239/228, 246, 251, 553, 239/553.5, 566, 598

[56] References Cited

U.S. PATENT DOCUMENTS

| | | | |
|---|---|---|---|
| 1,780,168 | 11/1930 | Burmeister | 239/443 |
| 1,901,683 | 3/1933 | Weidman | 239/246 |
| 2,359,690 | 10/1944 | Tarbox | 239/553.5 |
| 2,905,393 | 9/1959 | Federighi et al. | 239/251 X |
| 3,288,372 | 11/1966 | Cushing | 239/251 |
| 3,362,645 | 1/1968 | Clark | 239/251 |

*Primary Examiner*—John J. Love
*Assistant Examiner*—Jon M. Rastello
*Attorney, Agent, or Firm*—Wood, Dalton, Phillips, Mason & Rowe

[57] ABSTRACT

A rotary spray arm structure for a dishwasher or the like rotatable about an axis of rotation, the spray arm structure having an entrance passage coinciding with the axis of rotation for receiving a pressurized column of liquid, the entrance passage opening to a hollow interior of the spray arm, and a plurality of nozzles spaced along each hollow arm of the spray arm means with each nozzle having an entrance end at the hollow interior and an exit end for discharging the liquid, the hollow interior in each arm constricting from adjacent the axis of rotation to adjacent the outer end of each arm and liquid supply ramp means leading from the hollow interior of each arm to the inner entrance end of each nozzle with each ramp comprising a groove angled outwardly toward its nozzle.

8 Claims, 5 Drawing Figures

DISHWASHER UPPER SPRAY ARM

BACKGROUND OF THE INVENTION

This invention is directed to a rotary spray arm means as a part of dishwashers and particularly those having upper and lower racks and separate spray arms associated with each rack. In the dishwasher of this invention, as well as those of U.S. Pat. Nos. 3,180,348; 3,854,762 and patent application Ser. No. 166,082 filed July 3, 1980, now U.S. Pat. No. 4,301,822, all assigned to the assignee hereof, there is described a dishwasher having an upper rack on which is mounted a rotatable spray arm that is rotated by the reaction forces of spaced nozzles which also serve to spray washing and rinsing liquid over dishes held in the upper rack.

The rotatable spray arm is provided with liquid by an upwardly projected jet of liquid that enters a receiver and then flows into and through the spray arm thereby providing the force necessary to project the liquid through the nozzles.

As can be seen from this brief description, a most important element of such a dishwasher is the spray arm, as it is necessary not only that the arm provide nozzles for spraying the liquid over the dishes, but also that it be rotatable by the liquid pressure, that it distribute the liquid evenly over the dishes and that the liquid be distributed substantially uniformly at all radial distances from the axis of rotation of the spray arm.

The rotary spray means of this invention accomplishes these desirable and necessary functions.

The most pertinent patents of which applicants are aware are U.S. Pat. Nos. 2,359,690; 1,780,168 and 3,288,372.

Of these, U.S. Pat. No. 2,359,690 discloses a quenching nozzle having a tube with progressively contracting flow areas in combination with grooves 14 to provide a substantially uniform flow from each of the spray nozzles shown.

U.S. Pat. No. 1,780,168 discloses a fire extinguishing foam nozzle having adjustable outlets.

U.S. Pat. No. 3,288,372 discloses a sheet metal spray arm having openings formed at the apex of the dihedral angle over the top portion of a spray arm to provide a sheet-like jet of water generally aligned with the apex of the dihedral angle.

The invention as claimed herein differs from each of the structures shown in this most pertinent prior art.

SUMMARY OF THE INVENTION

In order to provide an even spray pattern and a fully rotatable spray arm means, the rotary spray means of this invention provides an elongated hollow interior structure having a central axis of rotation and a plurality, specifically two, hollow arms extending from the axis. An entrance passage means to the hollow interior is provided coinciding with the axis of rotation for receiving a pressurized stream of liquid in the manner described in the above application Ser. No. 166,082, now U.S. Pat. No. 4,301,822.

This rotary spray means has a plurality of lateral nozzles spaced outwardly along each hollow arm from the axis of rotation, with each nozzle having an entrance end at the hollow interior and an exit end, the hollow interior of each arm constricting from adjacent the axis of rotation to adjacent the outer end of each arm.

The hollow interior structure has a liquid supply ramp means leading from the hollow interior to the inner entrance end of each nozzle. Each ramp comprises a groove angled upwardly toward its nozzle in contrast to a generally uniform constricting of the hollow interior in each arm.

The nozzle end of each groove extends through one side of its nozzle with the side of each nozzle opposite the groove being solid so as to direct the liquid at the exit end of a groove into and through its corresponding nozzle.

DESCRIPTION OF THE PREFERRED EMBODIMENT

Figure 2:
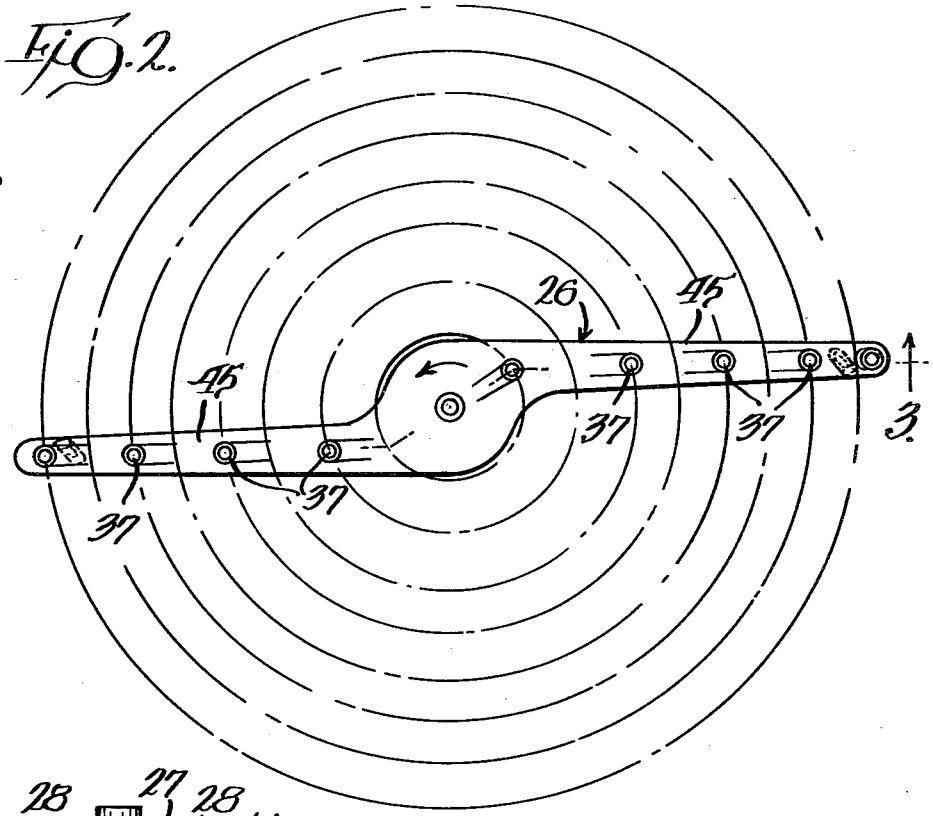
FIG. 2 is a detail plan view of the spray arm means of FIG. 1.
Figure 1:
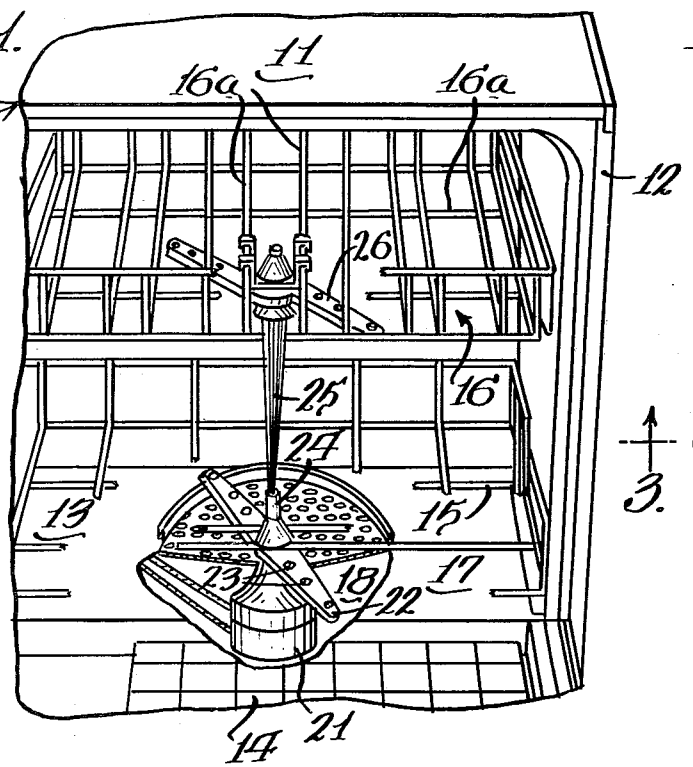
FIG. 1 is a perspective view, partially broken away, of the interior of a dishwasher having a spray arm means embodying the invention.

In the embodiment illustrated in the accompanying drawings, the dishwasher 10 comprises a top wall 11 of a cabinet 12 that has an interior washing cavity 13. This cabinet 12 also includes a front opening door 14 and the interior of the cabinet contains a bottom dish rack 15 of open construction and a top dish rack 16 of similar construction which are of the type customarily used.

The bottom 17 of the cavity 13 contains a sump 18 in which is located a motor and liquid pump 21 which supplies liquid under pressure from the sump to a bottom spray arm 22. This spray arm is elongated and is provided with spaced nozzles 23 therealong.

As a part of the spray arm 22, there is also provided a coaxial upwardly directed jet nozzle 24 for projecting a vertical liquid jet 25 to the top dish rack 16.

Figure 3:
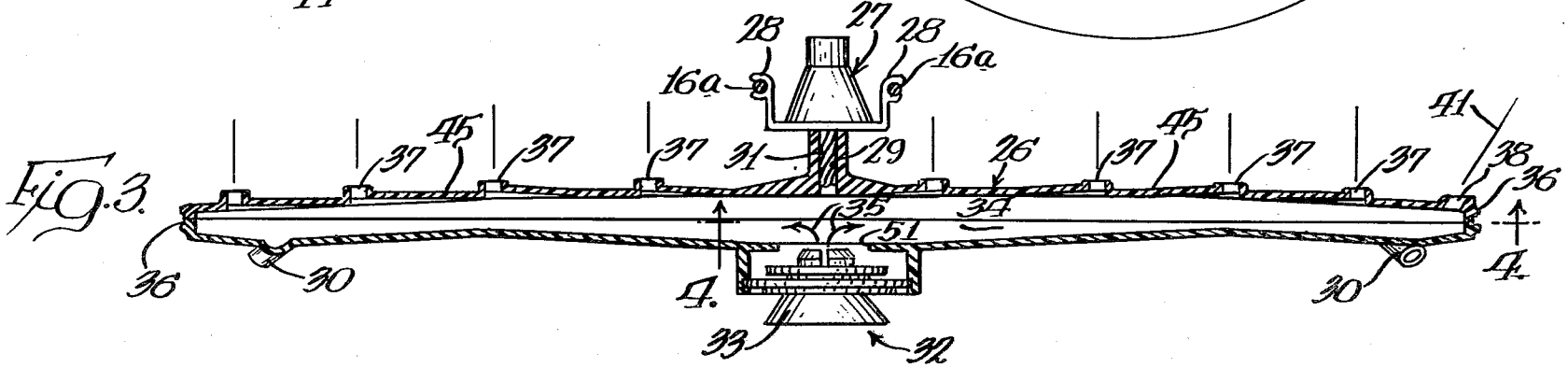
FIG. 3 is a sectional view taken along line 3—3 of FIG. 2.

Mounted on the top rack 16 in position to receive the vertical jet 25 is an upper spray means 26 generally of the type described in the above co-pending application 166,082. This upper spray means 26, which is mounted on the top dish rack 16 by means of a bearing structure 27, is illustrated in section detail in FIG. 3. As can be seen there and in the drawings generally, the spray means 26 is mounted on wires **16*a* of the upper rack 16 by means of spaced arms 28 of the bearing structure embracing the wires of the upper rack 16. The spray means 26 is attached to the bearing structure 27 by a bearing pin 29 rotatable in the bearing structure and secured in the arm by helical serrations 31**.

Positioned on the bottom of the spray means 26 is an entrance passage means 32 opening to a hollow interior 34 of the spray means. In the illustrated embodiment, this entrance passage means is in the form of a conical receiver 33 of the type described and claimed in the above co-pending application with the receiver 33 directing liquid into the hollow interior 34 of the arm means 26 as indicated by the arrows 35.

The spray means 26 has a plurality of the hollow arms 45, here shown as two, having closed outer ends 36 and a plurality of lateral nozzles 37, shown in the present embodiment as upwardly opening toward the upper rack 16, for spraying liquid from the hollow interior 34 onto dishes held in the upper rack. The nozzles 37 are closer together toward the outer ends 36 of the spray arms 45 than they are toward the axis of rotation which coincides with the central axis of the pin 29. This provides a more uniform volume of spray coverage to the rack 16 because the nozzles located closer to the axis of rotation have to cover only a small circumference while the nozzle at the end 36 has to cover a larger circumference.

In addition, there is provided an upwardly angled nozzle 38 at one end of the spray means 26 for angling liquid 41 upwardly and outwardly and two nozzles 30 in a lower side or portion **26*a* of arm 45 angled to provide a rotational force for the spray means 26**.

Figure 4:
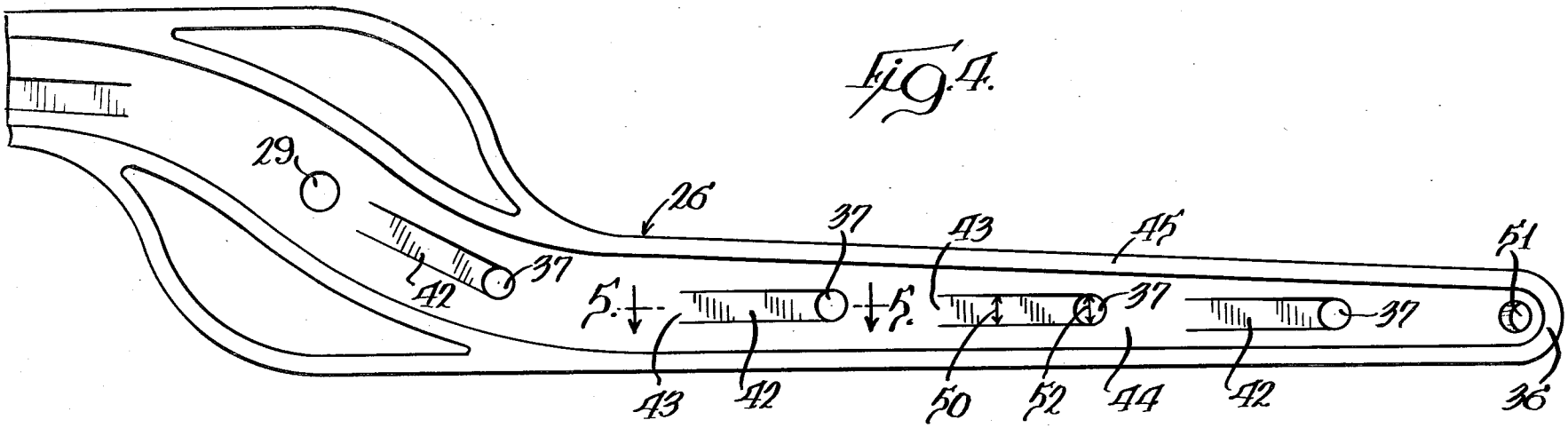
FIG. 4 is an enlarged elevational view of a portion of the upper side of the spray arm means and taken substantially along line 4—4 of FIG. 3.
Figure 5:
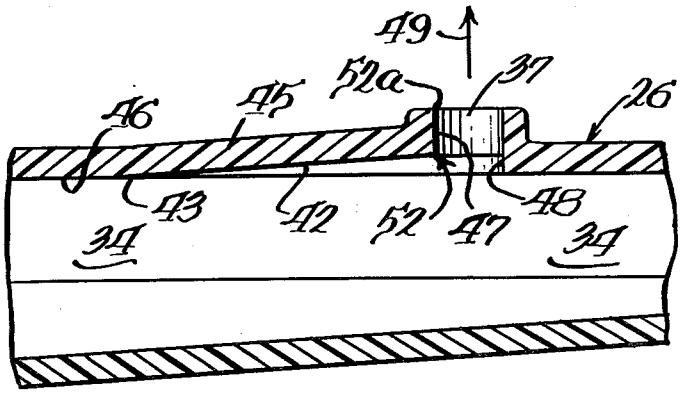
FIG. 5 is an enlarged sectional view taken along line 5—5 of FIG. 4.

As shown in FIGS. 4 and 5, each nozzle 37 has an angled liquid supply ramp 42 leading from the hollow interior 34 at a point 43. Each ramp 42 comprises a groove angled uniformly and outwardly from the hollow interior toward its nozzle as shown in FIG. 5 in contrast to a generally uniform constricting of the hollow interior 34 of each arm 45 of the spray means 26 from the entrance passage 32 to the closed ends 36.

The inner point 43 of each uniformly sloped ramp 42 coincides with an inner surface 46 of the arm 45 while the opposite end of the ramp 42 extends through an inner side 47 of a nozzle 37. A solid opposite side 48 of the nozzle 37 directs the liquid impinging on its outwardly and upwardly as indicated by the arrow 49.

The result of this construction is that the constricting inner passage 34 of the nozzle arms 45 together with the decreasing spacing of the nozzles 37 along each arm 45 causes a substantially uniform liquid flow into and through each arm. The auxiliary nozzle 38 at the extreme end of one arm 45 is not provided with such a ramp but is angled upwardly and outwardly as previously described to provide the liquid spray 41.

The rotary spray arms of this invention having the hollow arms extending from the axis of rotation and provided with spaced nozzles along these arms for projecting liquid over articles held as in a rack adjacent thereto, has several very desirable features. Thus, the rotary spray means provides an essentially constant volumetric velocity along its length because as the liquid is forced through the nozzles 37 by an inclined ramp 42 leading to each nozzle as shown in FIG. 5, the projected volume of water is essentially compensated for by the progressively smaller cross-sectional areas of the hollow interior 34 in progressing from the entering liquid supply 35 to the outer ends 36 of the pair of arms shown.

In addition, the area through which the entering streams 35 pass into the interior 34 is extremely large as shown at 51 so that this large throat offers very little restriction to liquid flow. Another feature that promotes this condition of essentially uniform flow is the fact that a width 50 (FIG. 4) of each groove 42 supplying its nozzle 37 is substantially the same as a corresponding entrance end diameter 52 of the nozzle itself. Each ramp or groove 42 also increases in depth as can be seen in FIG. 5 from point 43 until it reaches its nozzle 37. Each nozzle 37 diverges from its entrance end diameter 52 to an exit end diameter **52*a* so as to spray the liquid over a larger area of rack 16**.

The above construction maintains an essentially uniform velocity of liquid to all the nozzles 37 in the spray means 26 so as to reduce hydraulic losses in the system to a practical minimum.

We claim:

1. A rotary spray means for an article washing apparatus comprising:

an elongated hollow interior structure having a central axis of rotation and a plurality of arms extending from said axis, said arms having a hollow interior constricting from adjacent said central axis to an outer end of each arm, and each arm having an upper portion;

entrance passage means to said hollow interior coinciding with said axis of rotation for receiving a pressurized stream of liquid;

a plurality of nozzles spaced from said axis of rotation along said upper portion of each said arm, each nozzle extending transversely to the direction of elongation of said arms and having an entrance end opening to said hollow interior, and an exit end, said entrance end having a cross sectional dimension transversely to the longitudinal extent of said arms less than the transverse width of the arms thereat; and a plurality of liquid supply ramp means each leading from the said hollow interior to the inner entrance end of a corresponding one of a plurality of said nozzles, each said ramp means comprising a groove in said arm upper portions and having a width substantially equal to the cross-sectional dimension of the nozzle entrance end, said groove being angled outwardly from said hollow interior and extending to and through one side of said entrance end of said one nozzle, and the opposite side of said one nozzle forming a solid wall angled thereto so as to redirect the liquid from said groove outwardly through said one nozzle.

2. The spray means of claim 1 wherein the nozzles on each arm are progressively spaced closer together from the axis of rotation to the outer end.

3. The spray means of claim 1 wherein each ramp means has an entrance in said hollow interior between an adjacent pair of said nozzles and an exit at said entrance end of said nozzle and each groove having a width substantially equal to the corresponding width of its said nozzle.

4. The spray means of claim 1 wherein there is provided a single nozzle on a lower portion of each end of said spray arms, said single nozzle angled outwardly from the spray arm to provide a rotational force for the spray means.

5. The spray means of claim 1 wherein the nozzles of each end of the spray arm are progressively spaced closer together from the axis of rotation to the outer end and wherein each groove interior diverges outwardly from its ramp entrance to its nozzle entrance end.

6. The spray means of claim 5 wherein each ramp means has an entrance in said hollow interior between an adjacent pair of said nozzles and an exit at said entrance end of said one nozzle.

7. The spray means of claim 1 wherein each said ramp means has an interior liquid passage groove expanding from its entrance end to its exit end.

8. In a dishwasher having a cavity receiving articles to be washed and a motor pump means for recirculating washing liquid within said cavity, a spray means for distributing said washing liquid over said articles within said cavity, said spray means comprising:

a central portion having a mounting means for rotationally connecting said spray means to said cavity and an inlet for receiving washing liquid;

at least one arm fluidly connected to said central portion and extending radially outwardly generally in the plane of said rotation, said arm having a plurality of liquid spray nozzles extending transversely to the direction of elongation of said arms, said nozzles being spaced radially thereon, said spacing between nozzles decreasing from said central portion outwardly along said arm, each nozzle having a cross-sectional dimension transversely to the longitudinal extent of said arm less than the transverse width of the arm thereat; and a wall means forming a longitudinal hollow interior of said arm fluidly connecting said central portion to said nozzles, said wall means having groove means fluidly connected to said hollow interior and formed in the portions of said arm inwardly adjacent each of said nozzles for directing a portion of the washing liquid outwardly along the arm to said nozzles, each groove having a width substantially equal to the cross-sectional dimension of the nozzle, said hollow interior decreasing in cross-sectional area from said central portion to a distal end of said arm, whereby said spray means provides generally uniform velocity flow within said hollow interior and a generally uniform spray pattern from said nozzles.

* * * * *